US007009591B2

(12) United States Patent
Shibusawa

(10) Patent No.: US 7,009,591 B2
(45) Date of Patent: Mar. 7, 2006

(54) ACTIVE MATRIX TYPE DISPLAY APPARATUS

(75) Inventor: Makoto Shibusawa, Fukaya (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 0 days.

(21) Appl. No.: 10/942,015

(22) Filed: Sep. 16, 2004

(65) Prior Publication Data

US 2005/0057182 A1 Mar. 17, 2005

Related U.S. Application Data

(63) Continuation of application No. PCT/JP2004/006925, filed on May 14, 2004.

(30) Foreign Application Priority Data

May 16, 2003 (JP) ..... 2003-139440

(51) Int. Cl.
*G09G 3/30* (2006.01)

(52) U.S. Cl. ..... 345/76; 345/211; 345/92

(58) Field of Classification Search ..... 315/169.3; 345/76

See application file for complete search history.

(56) References Cited

U.S. PATENT DOCUMENTS

| | | | | |
|---|---|---|---|---|
| 2002/0005825 | A1 * | 1/2002 | Lee et al. | 345/76 |
| 2002/0195968 | A1 * | 12/2002 | Sanford et al. | 315/169.3 |
| 2003/0016190 | A1 * | 1/2003 | Kondo | 345/55 |
| 2003/0067424 | A1 * | 4/2003 | Akimoto et al. | 345/55 |
| 2004/0007989 | A1 * | 1/2004 | Li | 315/169.3 |
| 2004/0017162 | A1 * | 1/2004 | Sato et al. | 315/169.3 |
| 2005/0174307 | A1 * | 8/2005 | Nishitoba et al. | 345/76 |

FOREIGN PATENT DOCUMENTS

| | | |
|---|---|---|
| JP | 2002-514320 | 5/2002 |
| JP | 2002-517806 | 6/2002 |

* cited by examiner

*Primary Examiner*—Wilson Lee
*Assistant Examiner*—Angela M Lie
(74) *Attorney, Agent, or Firm*—Oblon, Spivak, McClelland, Maier & Neustadt, P.C.

(57) ABSTRACT

A plurality of display pixels PX arranged in a matrix form respectively have a driving transistor which controls an electric current amount made to flow in a self-luminescent element, in accordance with an image signal, a first switch formed of a transistor and connected between a gate and a drain of the driving transistor, and a second switch formed of a transistor and connected between the driving transistor and the self-luminescent element. A first capacitance Cs is provided between the gate and a source of the driving transistor, and a second capacitance Cx is provided between the second switch and the gate of the driving transistor.

8 Claims, 4 Drawing Sheets

ACTIVE MATRIX TYPE DISPLAY APPARATUS

CROSS-REFERENCE TO RELATED APPLICATIONS

This is a Continuation Application of PCT application No. PCT/JP2004/006925, filed May 14, 2004.

This application is based upon and claims the benefit of priority from the prior Japanese Patent Application No. 2003-139440, filed May 16, 2003, the entire contents of which are incorporated herein by reference.

BACKGROUND OF THE INVENTION

1. Field of the Invention

The present invention relates to an active matrix type display apparatus wherein a display screen is configured by arranging display pixels including self-luminescent elements such as, for example, an electroluminescence (hereinafter, referred as EL) element in a matrix form.

2. Description of the Related Art

Flat panel type display apparatuses have been broadly used as a display apparatus for a personal computer, an personal digital assistant, a television, or the like. In recent years, as such a flat panel type display apparatus, an active matrix type organic EL display apparatus using a self-luminescent element such as an organic EL element has been given the attention, and the research and development thereof have been actively carried out. The organic EL display apparatus has the following features: it does not require a backlight preventing the organic EL display apparatus from being made to be thin and light-weight, it has a high-speed responsiveness and is suitable for playing-back moving picture, and moreover, it can be used at cold districts as well, because the brightness thereof is not reduced at a low temperature.

Generally, the organic EL display apparatus comprises a plurality of display pixels which are arranged in a plural rows and a plural columns to constitute a display screen, a plurality of scanning lines extending along the respective rows of the display pixels, a plurality of signal conductor lines extending along the respective columns of the display pixels, a scanning line driving circuit for driving the respective scanning lines, a signal conductor line driving circuit for driving the respective signal conductor lines, and the like. Each display pixel includes an organic EL element which is a self-luminescent element, and a pixel circuit for supplying a driving electric current to the organic EL element. The pixel circuit has a pixel switch disposed in the vicinity of the cross positions of the scanning lines and the signal conductor lines, a driving transistor which is connected in series to the organic EL element between a pair of power source lines, and which is formed of a thin-film transistor, and a storage capacitance retaining the gate control voltage of the driving transistor. The pixel switch is made to be conductive in response to a scanning signal supplied from a corresponding scanning line, and acquires an image signal supplied from a corresponding signal conductor line into the pixel circuit. The image signal is written as the gate control voltage into the storage capacitance, and is stored for a predetermined period. The driving transistor supplies an electric current amount corresponding to the gate control voltage written in the storage capacitance to the organic EL element, and the organic EL element is operated to emit light.

The organic EL element has a cathode, an anode, and an emitting layer which is formed of a thin-film including a fluorescent organic compound and provided between the cathode and the anode. The organic EL element generates an exciton by injecting electrons and holes into the emitting layer and recombining those, and emits light due to the light emission generated at the time of deactivation of the exciton. The organic EL element emits light at a brightness corresponding to a supplied electric current amount, and a brightness of about 100 to 100,000 cd/m$^2$ can be obtained by even an applied voltage equal to or less than 10 V.

In the organic EL display apparatus, a thin-film transistor serving as the driving transistor has a semiconductor thin-film formed on an insulating substrate such as a glass. Therefore, the characteristics of the driving transistor such as a threshold voltage Vth and a carrier mobility $\mu$ depend on the manufacturing process or the like, and easily vary. If there is unevenness in the threshold voltage Vth of the driving transistor, it is difficult to make the organic EL element emit light at an appropriate brightness. Thus, an irregularity in brightness among the plurality of display pixels arises, which causes unevenness in displaying.せい

For example, in U.S. Pat. No. 6,229,506, there is disclosed a display apparatus in which threshold canceling circuits are provided at all of display pixels in order to avoid the effect due to the irregularity in the threshold voltage Vth. Each threshold canceling circuit is configured such that the control voltage of the driving transistor is initialized by a reset signal supplied in advance of an image signal from the signal conductor line driving circuit. Further, as the other display apparatus, in U.S. Pat. No. 6,373,454, there is proposed a display apparatus in which writing of an image signal is carried out by an electric current signal, and an attempt is made to uniform the brightness of light emission by reducing the effect due to the irregularity in the threshold voltage in the driving transistor.

In the display apparatus described above, the pixel circuit of each display pixel has one or more switches which are connected between a gate and a drain of the driving transistor, and which are in OFF-states for a period of light-emitting, and the switches are respectively formed of thin-film transistors. However, in such a pixel circuit, when these switches are switched from being on to being off, feedthrough voltages due to the parasitic capacitance formed between the gates and the sources of the switches are generated. Further, a gate control voltage of the driving transistor is varied by an amount corresponding to the amount of the generated feedthrough voltages. Because the feedthrough voltage depends on a threshold voltage of the switch, an irregularity arises in the gate control voltage of the driving transistor due to the irregularity in the threshold voltage, and an irregularity in brightness arises among the plurality of display pixels. Such an irregularity in brightness among the display pixels appears as the unevenness in displaying, which deteriorates the quality of displaying.

For example, when the above-described switches and the driving transistor are formed of P-channel type thin-film transistors, the gate control voltage of the driving transistor is varied in plus electric potential direction, and electric current made to flow in the driving transistor changes for being reduced. This leads to a reduction in EL light emitting current, which decreases white brightness on a displayed image.

By supplying from the driving circuit an image signal to which an amount of the reduction in light emitting current is added in advance, the problem of the insufficient white brightness can be avoided. However, in this case, a rise in a driving voltage of the driving circuit, upsizing of the driving circuit, an increase in manufacturing cost, or the like are brought about.

BRIEF SUMMARY OF THE INVENTION

The present invention has been contrived in consideration of the above-described problems, and its object is to provide an active matrix type display apparatus in which variation in the electric potential of a driving transistor due to a feedthrough voltage is compensated for, and the quality of displaying is improved.

In order to achieve the object, an active matrix type display apparatus according to an aspect of the present invention comprises: a self-luminescent element which is connected to a first voltage power source line and which emits light in accordance with a supplied electric current; a driving transistor which is connected between a second voltage power source line and the self-luminescent element and which controls an electric current amount supplied to the self-luminescent element in accordance with a gate control voltage; a first switch formed of a transistor and connected between a gate and a drain of the driving transistor; a first capacitance connected to the gate of the driving transistor; a second switch formed of a transistor and connected between the drain of the driving transistor and the self-luminescent element; and a second capacitance connected between the second switch and the gate of the driving transistor.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

An active matrix type organic EL display apparatus according to a first embodiment of the present invention will be described in detail with reference to the accompanying drawings.

Figure 1:
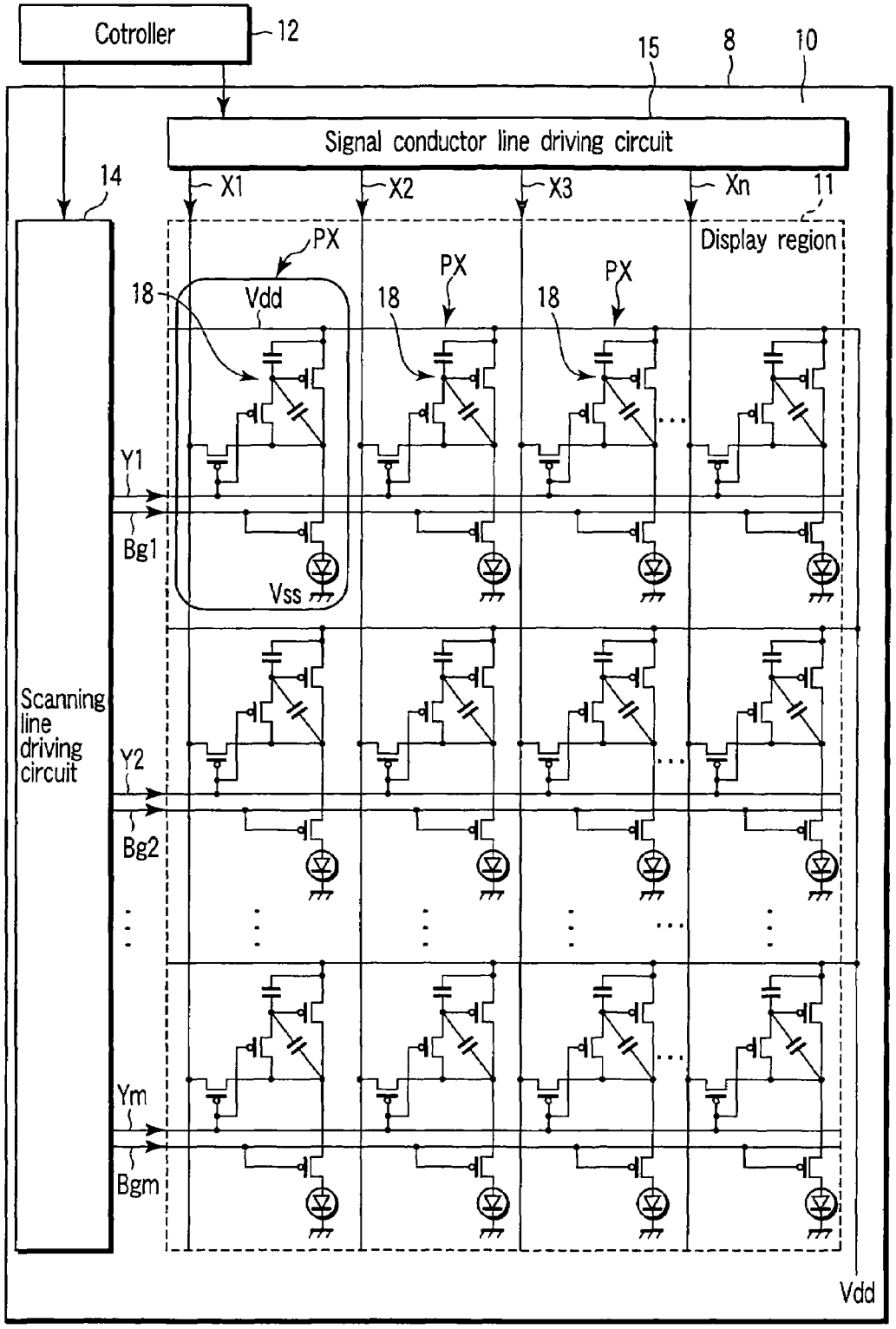
FIG. 1 is a circuit diagram illustrating a configuration of an organic EL display apparatus according to a first embodiment of the present invention.

As shown in FIG. 1, the organic EL display apparatus has an organic EL panel 10 and a controller 12 for controlling the organic EL panel 10.

The organic EL panel 10 has m×n of display pixels PX which are arranged in a matrix form on a light transmittable insulating substrate 8 such as a glass plate or the like, and which configure a display region 11, first scanning lines Y (Y1 to Ym) and second scanning lines Bg (Bg1 to Bgm) which are connected to the respective rows of the display pixels and are independently provided by m lines, n of signal conductor lines X (X1 to Xn) connected to the respective columns of the display pixels, a scanning line driving circuit 14 for successively driving the first and second scanning lines Y and Bg for each row of the display pixels, and a signal conductor line driving circuit 15 for driving the signal conductor lines X1 to Xn. The driving circuits 14 and 15 are provided on the insulating substrate 8.

Figure 2:
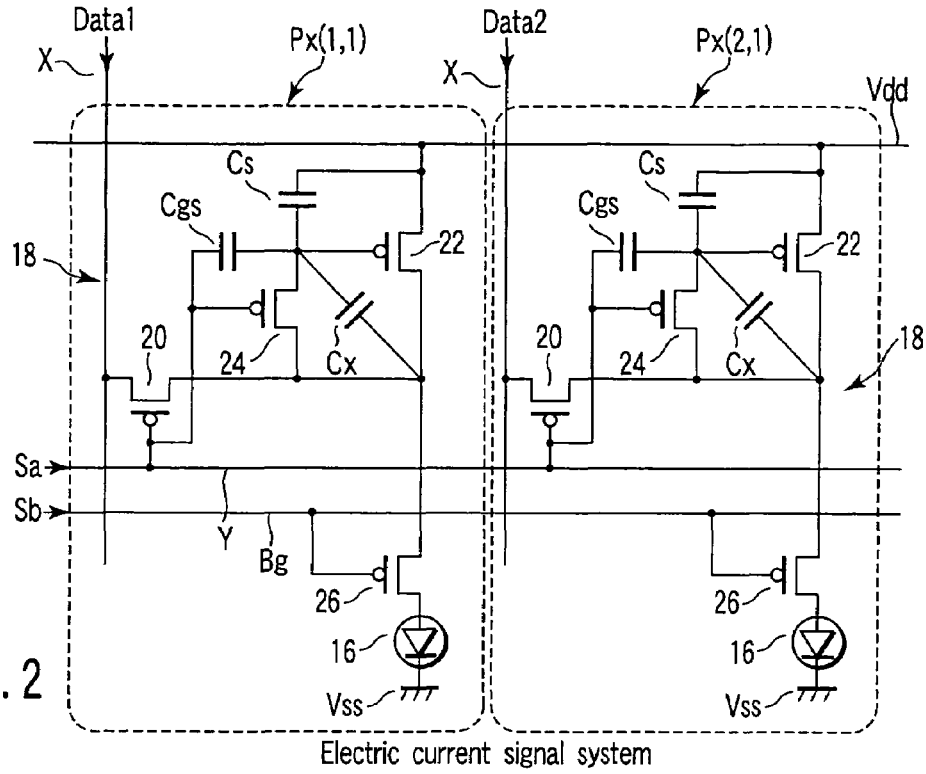
FIG. 2 is a diagram illustrating an equivalent circuit of display pixels in the organic EL display apparatus.
Figure 3:
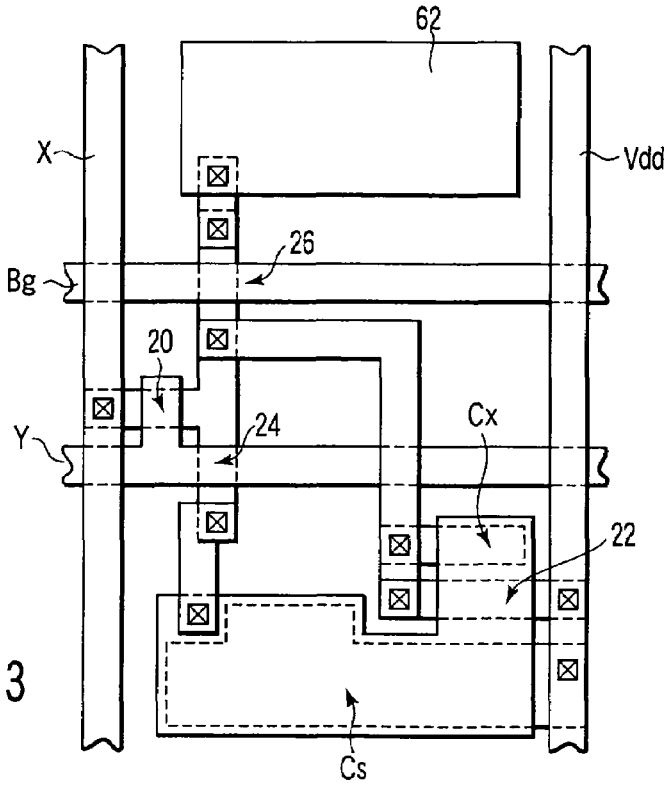
FIG. 3 is a plan view schematically illustrating the display pixel.

Each display pixel PX includes an organic EL element 16 serving as a self-luminescent element, and a pixel circuit 18 for supplying a driving electric current to the organic EL element. An equivalent circuit of the display pixels is shown in FIG. 2, and one example of a planar structure is shown in FIG. 3. The pixel circuit 18 is a current signal system pixel circuit for controlling the light emission of the organic EL element 16 in accordance with an image signal formed of an electric current signal, and has a pixel switch 20, a driving transistor 22, a first switch 24, a second switch 26, and a first capacitance Cs functioning as a storage capacitance and a second capacitance Cx. The pixel switch 20, the driving transistor 22, the first switch 24, and the second switch 26 are configured of the same conductivity type transistors, for example, P-channel type thin-film transistors.

The driving transistor 22, the second switch 26 and the organic EL element 16 are connected in series between a first voltage power source line Vss and a second voltage power source line Vdd. The source of the driving transistor 22 is connected to the second voltage power source line Vdd. One electrode, i.e., a cathode, of the organic EL element 16 is connected to the first voltage power source line Vss. The source of the second switch 26 is connected to the drain of the driving transistor 22, and the drain thereof is connected to the anode of the organic EL element 16. Moreover, the gate the second switch 26 is connected to the second scanning line Bg. The first and second voltage power source lines Vss and Vdd are respectively set to, for example, the electric potentials of 0 V and +10 V.

The driving transistor 22 outputs signal electric current corresponding to an image signal to the organic EL element 16. The second switch 26 is controlled to be turned on (in a state of being conductive) and off (in a state of being nonconductive) by a control signal Sb from the second scanning line Bg, and controls the connection and non-connection between the driving transistor 22 and the organic EL element 16.

The first capacitance Cs is connected between the source and the gate of the driving transistor 22, and retains the gate control electric potential of the driving transistor 22 determined by the image signal. The first capacitance Cs has a pair of tabular electrodes facing each other in parallel, and is formed as a parallel plate type capacitance by a gate electrode film and a polysilicon layer of the driving transistor.

The pixel switch 20 is connected between the signal conductor line X corresponding thereto and the drain of the driving transistor 22, and the gate thereof is connected to the first scanning line Y. The pixel switch 20 acquires an image signal from the corresponding signal conductor line X in response to a control signal Sa supplied from the first scanning line Y.

The first switch 24 is connected between the drain and the gate of the driving transistor 22, and the gate thereof is connected to the first scanning line Y. The first switch 24 is turned on and off in accordance with the control signal Sa from the first scanning line Y, and controls the connection and non-connection between the gate and the drain of the driving transistor 22. In FIG. 2, Cgs denotes a parasitic capacitance generated between the gate and the source of the first switch 24.

The second capacitance Cx is connected between the source of the second switch 26 and the gate of the driving transistor 22. The second capacitance Cx has a pair of tabular electrodes facing each other in parallel, and is formed as a parallel plate type capacitance. The capacitance value of the second capacitance Cx can be adjusted by an area of the capacitance, and a concrete capacitance value will be described later.

In the present embodiment, all of the thin-film transistors constituting the pixel circuits 18 are formed by the same process, have the same layer structure, and are thin-film transistors having a top gate structure using polysilicon as the semiconductor layers. Due to all of the pixel circuits 18 being configured of the same conductivity type thin-film transistors, an increase in the number of manufacturing processes can be suppressed. The second switch 26 may be formed of a conductivity type thin-film transistor which is different from the pixel switch and the first switch, i.e., an N-channel type thin-film transistor. In this case, control of the gate of the second switch 26 may be carried out by the same signal which is used for the control of the pixel switch 20, thorough the first scanning line Y.

Figure 4:
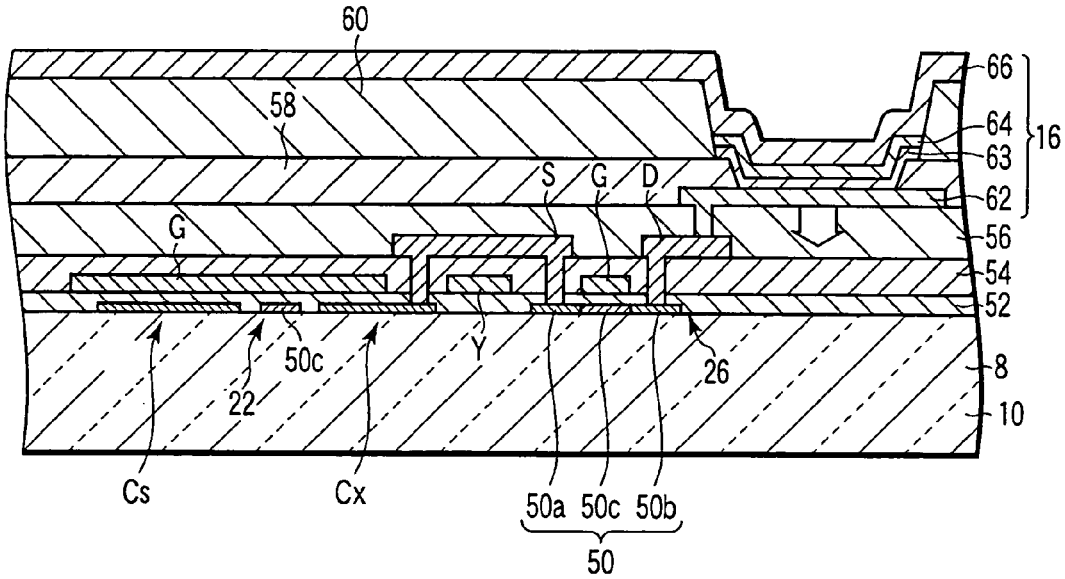
FIG. 4 is a cross sectional view illustrating a part of the organic EL display apparatus.

Next, the configurations of the pixel circuit 18 and the organic EL element 16 will be described in detail with reference to FIGS. 3 and 4. FIG. 4 illustrates one example of the structure, in particular, of the second switch 26, the second capacitance Cx, the driving transistor 22, the first capacitance Cs, and the organic EL element 16 in the pixel circuit 18.

The P-channel type thin-film transistor constituting the second switch 26 has a semiconductor layer 50 formed on the light transmittable insulating substrate 8 and formed of polysilicon. The semiconductor layer 50 has a source region 50*a*, a drain region 50*b*, and a cannel region 50*c* positioned between the source region and the drain region. A gate insulating film 52 is formed on the semiconductor layer 50, and a gate electrode G is provided on the gate insulating film so as to face the channel region 50*c*. An interlayer insulating film 54 is formed on the gate electrode G, and a source electrode (source) S and a drain electrode (drain) D are provided on the interlayer insulating film. The source electrode S and the drain electrode D are respectively connected to the source region 50*a* and the drain region 50*b* of the semiconductor layer 50 via contacts which extend passing through the interlayer insulating film 54 and the gate insulating film 52. The respective thin-film transistors configuring the first switch 24, the pixel switch 20, and the driving transistor 22 are formed so as to have the same structure described above.

A plurality of wirings such as the signal line X, the second voltage power source line Vdd, and the like are provided on the interlayer insulating film 54. On the interlayer insulating film 54, a passivation film 56 is formed so as to cover the source electrode S, the drain electrode D, and the wirings. A hydrophilic film 58, a partition film 60 are successively laminated on the passivation film 56.

The organic EL element 16 has an anode 62, a cathode 66 and an organic emitting layer 64 including luminescence organic compound and interposed between the anode 62 and the cathode 66. The anode 62 is formed of a transference electrode material such as ITO (indium tin oxide) or the like, and is provided on the passivation film 56. Those portions of the hydrophilic film 58 and the partition film 60 which are located on the anode 62 have been eliminated by etching. Further, an anode buffer layer 63 and an organic luminescent layer 64 are formed on the anode 62. The cathode 66 formed of, for example, barium-aluminum alloy is laminated on the organic luminescent layer 64 and the partition film 60.

In the organic EL element 16 having such a structure, when a hole injected from the anode 62 and an electron injected from the cathode 66 are recombined at the inside of the organic emitting layer 64, an exciton is generated by exciting organic molecules configuring the organic emitting layer. Light is generated in the process of deactivation of the radiation of the exciton, and the light is emitted to the exterior via the transparence anode 62 and the light transmittable insulating substrate 8 from the organic emitting layer 64.

In the above embodiment, the anode 62 is connected to the drain of the driving transistor 22, and the cathode 66 is connected to the first voltage power source line Vss. However, the cathode 66 may be connected to the drain of the driving transistor 22, and the anode 62 may be connected to the first voltage power source line Vss.

In the above-described embodiment, the substrate 8 side on which the organic EL element 16 is formed is the display surface. However, the side (the cathode 66 side in the above-described embodiment) facing the substrate 8 on which the organic EL element 16 has been formed may be the display surface.

In any case, the light emitting surface side must be formed of a transparent conductive material. For example, when the cathode 66 is disposed on the light emitting side, the formation can be achieved by forming alkaline earth metal or rare earth metal so as to be thin to an extent of having a light permeability.

The controller 12 shown in FIG. 1 is formed on a printed circuit board disposed at the outside of the organic EL panel 10, and controls the scanning line driving circuit 14 and the signal conductor line driving circuit 15. The controller 12 receives a digital image signal and a synchronization signal supplied from an external device, generates a vertical scanning control signal for controlling the timing of vertical scanning and a horizontal scanning control signal for controlling the timing of horizontal scanning on the basis of the synchronization signal, and supplies the vertical scanning control signal and the horizontal scanning control signal respectively to the scanning line driving circuit 14 and the signal conductor line driving circuit 15. Further, the controller 12 supplies the digital image signal to the signal conductor line driving circuit 15 synchronously with the horizontal and vertical timings.

The signal conductor line driving circuit 15 converts image signals Data1 to Datam successively obtained at respective horizontal scanning periods by the control of the horizontal scanning control signal into analog formats, and supplies the analog signals as electric current signals to the plurality of signal conductor lines X in parallel. The scanning line driving circuit 14 includes a shift register, an output buffer, and the like, and successively transfers horizontal scanning start pulses supplied from the exterior, to the next stage, and supplies two types of control signals, i.e., the control signal Sa and the control signal Sb to the display pixels PX at the respective rows via the output buffer. In accordance therewith, the respective first and second scanning lines Y and Bg are respectively driven by the control signal Sa and the control signal Sb at the first horizontal scanning periods different from one another.

Figure 5:
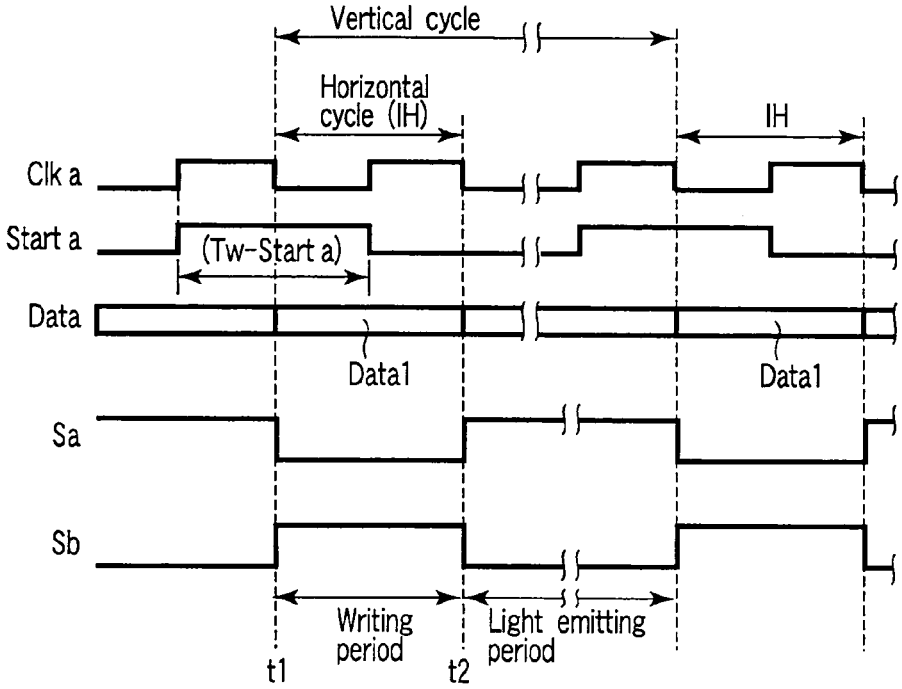
FIG. 5 is a timing chart for explanation of the operation of the display pixel shown in FIG. 2.

The operation of the pixel circuit 18 based on the output signals from the scanning line driving circuit 14 and the signal conductor line driving circuit 15 will be described with reference to a timing chart shown in FIG. 5.

The scanning line driving circuit 14 generates a pulse having widths (Tw-Starta) corresponding to the respective horizontal scanning periods on the basis of, for example, a start signal a (Starta) and a clock a (Clka), and outputs the pulse as the control signal Sa. Further, the scanning line driving circuit 14 generates the control signal Sb by inverting the control signal Sa.

The operation of the pixel circuit 18 can be divided into an image signal writing operation and a light emitting operation. At a point in time t1 of FIG. 5, when the control signals Sa and Sb for turning the pixel switch 20 and the first switch 24 on (in a state of being conductive) and turning the second switch 26 off (in a state of being nonconductive), i.e., the control signal Sa which is at a low level and the control signal Sb which is at a high level here, are outputted, the image signal writing operation is started. For an image signal writing period (t1 to t2), the driving transistor 22 is in a state of diode connection, and the image signal Data is acquired from the corresponding signal conductor line X via the pixel switch 20. By the source of constant current outputting a value of the constant current corresponding to an image signal, the electric current made to flow between the source and the drain of the driving transistor 22 is set to the value of constant current. In accordance therewith, image signal writing is carried out, and an electric potential between the gate and the source of the driving transistor in which the electric current amount can be made to flow is written into the first capacitance Cs.

Next, at a point in time t2, the control signal Sa and the control signal Sb are respectively made to be at a high level and at a low level, and the pixel switch 20 and the first switch 24 are turned off, and the second switch 26 is turned on. In accordance therewith, the image signal writing operation is completed, and light emitting operation is started. For the light-emitting period, the driving transistor 22 is turned on by the gate control voltage written in the first capacitance Cs, and supplies an electric current amount corresponding to the image signal to the organic EL element 16. Thus, the organic EL element 16 emits light, and the light emitting operation is started. The organic EL element 16 maintains the light emitting state until the time when the control signal Sa is supplied again after a period of one frame.

At the time of completing the writing period, when the first switch 24 is switched from the ON-state to the OFF-state, a feedthrough voltage due to the parasitic capacitance Cgs of the first switch is generated, and is supplied to the first capacitance Cs. Accordingly, the electric potential of the first capacitance Cs, i.e., the gate electric potential of the driving transistor 22 is displaced in plus direction. In contrast thereto, after the first switch 24 is made to be in the OFF-state, when the second switch 26 is switched from the OFF-state to the ON-state, the source electric potential of the second switch is displaced in minus electric potential direction. This electric potential displacement in minus direction is transmitted to the gate of the driving transistor 22 through the second capacitance Cx provided between the source of the second switch 26 and the gate of the driving transistor 22. In accordance therewith, the plus displacement of the gate electric potential generated at the time of switching the first switch 24 off is compensated for by the minus displacement generated at the source of the second switch 26, and the amount of the variation in the gate electric potential of the driving transistor 22 can be compensated for.

In order to compensate for the variation in the gate control voltage, it is preferable that the second capacitance Cx has such a capacitance value that the sum of the plus displacement and the minus displacement of the gate electric potential described above is made to be zero. The capacitance value of the second capacitance Cx can be adjusted by controlling an area of the capacitance, and is set in consideration of the parasitic capacitance Cgs, the first capacitance Cs, an electric potential difference between the ON-state and OFF-state electric potentials of the control signal Sa, of the first switch 24, or the like.

For example, given that Cgs=0.01 pF, Cs=1 pF, and an electric potential difference ΔVs1, between the ON-state and OFF-state electric potentials of first switch 24,=15 V, a gate electric potential displacement amount ΔVg1 of the driving transistor 22 which is generated when the first switch 24 is switched off, i.e., a generated feedthrough voltage is approximated by $$\Delta Vg1=\{Cgs/(Cgs+Cs)\}\times\Delta Vs1,$$

and it follows that ΔVg1=150 mV.

On the other hand, a gate electric potential displacement amount ΔVg2 of the driving transistor 22 when the second switch 26 is turned on depends on a source electric potential displacement amount ΔVs2 and the second capacitance Cx of the second switch, and is approximated by $$\Delta Vg2=\{Cx/(Cx+Cs)\}\times\Delta Vs2.$$

The source electric potential displacement amount ΔVs2 of the second switch 26 is expressed by a difference between the drain electric potential of the driving transistor 22 at the time of image signal writing operation and the anode potential of the organic EL element 16 at the time of light emitting operation, and it is, for example, about −5 V.

Provided that the second capacitance Cx which results in ΔVg1+ΔVg2=0 is determined by using these values, it follows 0.03 pF, and it suffices that the area of the capacitance is determined on the basis of the value. For example, in the capacitance with an oxide film whose film thickness is 100 nm being used as a dielectric, an area of the capacitance corresponding to 0.03 pF is 9×9 $\mu$m=81 $\mu m^2$. If the second capacitance Cx has such an area, there are few constraints on an area, when the second capacitance is added to the display pixel Px.

As described above, in the organic EL display apparatus according to the present embodiment, the second capacitance Cx is provided between the source of the second switch 26 and the gate of the driving transistor 22, and the variation in the gate electric potential of the driving transistor generated at the time of switching the first switch 24 off can be compensated for. Therefore, while reliably carrying out the image signal writing operation, the influence of the variation or irregularity in the gate control voltage of the driving transistor caused by a feedthrough voltage can be reduced, and the irregularity in brightness among a plurality of display pixels can be suppressed. Further, there is no need to supply an excessive electric current amount from the driving circuit for the purpose of compensating the variation in the gate control voltage, and sufficient white brightness can be obtained without increasing the driving voltage and the size of the driving circuit, and increasing in manufacturing cost thereof. Accordingly, there can be provided an active matrix type organic EL display apparatus in which unevenness in displaying is prevented, and the quality of displaying is improved.

As shown in the above-described embodiment, it is preferable that the second capacitance Cx is set to be $\Delta Vg1+\Delta Vg2=0$. However, the present invention is not limited thereto. Provided that the second capacitance Cx has a capacitance value compensating for at least some of the variation in the gate electric potential generated at the time of switching the first switch 24 off, the effect on the reduction of the variation in the gate control voltage can be obtained.

Figure 6:
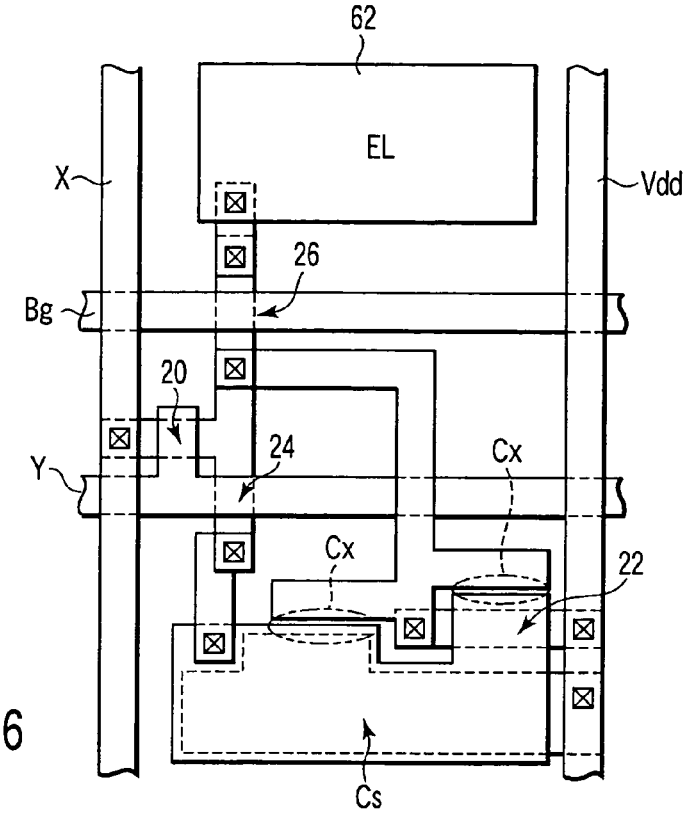
FIG. 6 is a plan view schematically illustrating the display pixel in an organic EL display apparatus according to a second embodiment of the present invention.

The parallel plate type capacitance is used as the second capacitance Cx. However, a parallel inter-wiring capacitance may be used. For example, when a luminous efficiency of the organic EL element is high, or when high white brightness of the display screen is not required, a voltage for the light emission of the organic EL element and a voltage for driving a pixel circuit in the organic EL display apparatus can be made to be low. As one example, given that the electric potential difference $\Delta Vs1$ between the ON-state electric potential and the OFF-state electric potential of the first switch 24 is 10 V, and the other conditions are the same as the embodiment described above, it follows that a required capacitance value of the second capacitance Cx is 0.02 pF. As shown in FIG. 6, the second capacitance Cx having such a capacitance value can be formed by a parallel inter-wiring capacitance. Namely, the second capacitance Cx has at least a pair of wirings, and these wirings are arranged in parallel with a predetermined gap without superposing onto each other.

When the parallel inter-wiring capacitance is used as the second capacitance Cx, there can be obtained the advantage in which layer-to-layer short can be exactly avoided as compared with the case of the parallel plate type capacitance. For example, it is possible to constitute a capacitance of 0.02 pF by using parallel wirings whose space is about 1 $\mu$m and whose parallel length is about 80 $\mu$m. In the second embodiment shown in FIG. 6, the configurations other than the second capacitance Cx are the same as the first embodiment, and the same portions as in the first embodiment are denoted by the same reference numerals, and detailed descriptions thereof will be omitted.

Figure 7:
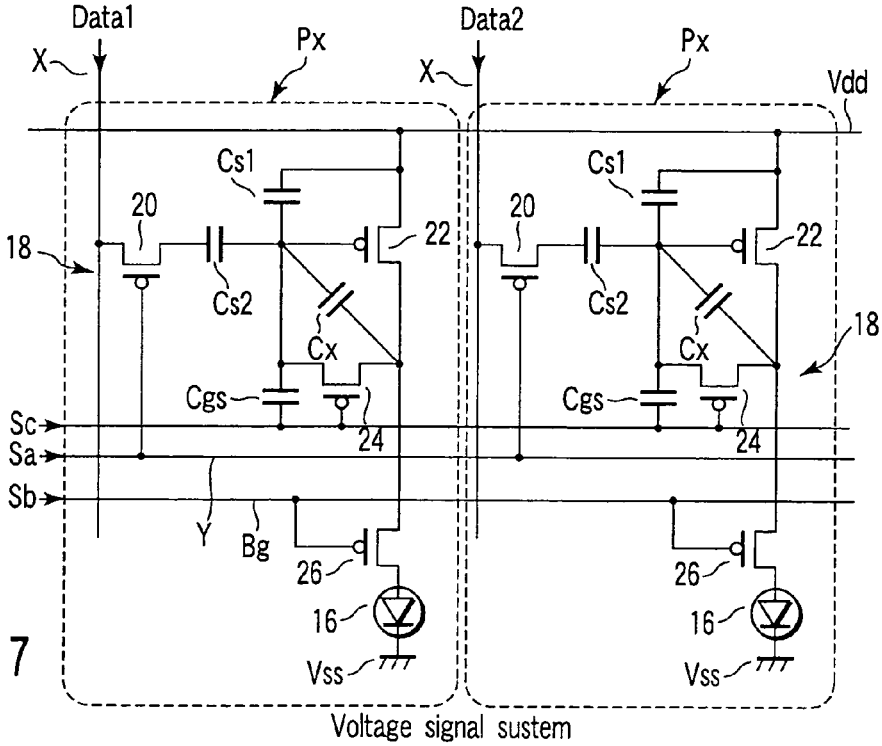
FIG. 7 is a diagram illustrating an equivalent circuit of display pixels in an organic EL display apparatus according to a third embodiment of the present invention.

The pixel circuit of the organic EL display apparatus may be structured as, not only the electric current signal system pixel circuit, but also a voltage signal system pixel circuit. FIG. 7 illustrates display pixels PX of an organic EL display apparatus according to a third embodiment of the present invention. Each display pixel PX includes an organic EL element 16 which is a self-luminescent element, and a pixel circuit 18 for supplying a driving electric current to the organic EL element. The pixel circuit 18 is a voltage signal system pixel circuit for controlling the light emission of the organic EL element 16 in accordance with an image signal formed of a voltage signal, and has a pixel switch 20, a driving transistor 22, a first switch 24, a second switch 26, a first capacitance Cs1, a second capacitance Cx, and a third capacitance Cs2. The pixel switch 20, the driving transistor 22, the first switch 24, and the second switch 26 are configured of the same conductivity type transistors, for example, P-channel type thin-film transistors.

The source of the driving transistor 22 is connected to a high potential second voltage power source line Vdd. A first capacitance Cs1 is connected between the gate and the source of the driving transistor 22, and the first switch 24 is connected between the gate and the drain of the driving transistor 22. The gate of the driving transistor 22 is connected to the drain of the pixel switch 20 via the third capacitance Cs2, and the source of the pixel switch is connected to a signal conductor line X.

The drain of the driving transistor 22 is connected to the source of the second switch 26, and the drain of the second switch is connected to the anode of the organic EL element 16. The cathode of the organic EL element 16 is connected to a low potential first voltage power source line Vss. The second capacitance Cx is formed of, for example, a parallel plate type capacitance, and is connected between the source of the second switch 26 and the gate of the driving transistor 22.

The image signal Data which is outputted from a signal conductor line driving circuit (not shown) and which is formed of a voltage signal is inputted to each pixel circuit 18 via the signal conductor line X. The pixel switch 20, the first switch 24, and the second switch 26 are respectively controlled to be turned on and off by a control signal Sa, a control signal Sb, and a control signal Sc generated at a scanning line driving circuit (not shown).

In the third embodiment, since the second capacitance Cx is provided between the source of the second switch 26 and the gate of the driving transistor 22, the variation in the gate electric potential of the driving transistor generated at the time of switching the first switch 24 off can be compensated for. In accordance therewith, at the time of completing Vth canceling operation, the influence of the variation or irregularity in the gate control voltage of the driving transistor caused by a feedthrough voltage can be reduced, and the irregularity in brightness among a plurality of display pixels can be suppressed. Accordingly, there can be obtained an active matrix type organic EL display apparatus which is prevented from generating unevenness in displaying, and in which the quality of displaying is improved, without increasing the driving voltage and the size of the driving circuit and without increasing manufacturing cost thereof.

The present invention is not limited to the above-described embodiments, and the components can be modified and materialized within a range which does not deviate from the gist of the present invention at the stage of implementing the invention. Further, various inventions can be formed due to the plurality of components disclosed in the above-described embodiments being appropriately combined. For example, some components may be eliminated from all of the components shown in the embodiments. Moreover, the components ranging over the different embodiments may be appropriately combined.

In the embodiments described above, all of the thin-film transistors constituting the pixel circuits are formed of the same conductivity type transistors, i.e., P-channel type transistors here. However, the thin-film transistors may be configured of N-channel type thin-film transistors. Further, the pixel circuit can be formed by including different conductive type thin-film transistors together such that, respectively, the pixel switch and the first switch are formed of N-channel type thin-film transistors, and the driving transistor and the second switch are formed of P-channel type transistors, or the like.

The semiconductor layer of the thin-film transistor may be configured of, not only polysilicon, but also amorphous silicon. The self-luminescent element constituting the display element is not limited to an organic EL element, and various luminescent elements which can emit light itself may be applied thereto.

What is claimed is:

1. An active matrix type display apparatus comprising:

a self-luminescent element which is connected to a first voltage power source line and which emits light in accordance with a supplied electric current;

a driving transistor which is connected between a second voltage power source line and the self-luminescent element and which controls an electric current amount supplied to the self-luminescent element in accordance with a gate control voltage;

a first switch formed of a transistor and connected between a gate and a drain of the driving transistor;

a first capacitance connected to the gate;

a second switch formed of a transistor and connected between the drain of the driving transistor and the self-luminescent element; and a second capacitance connected between the second switch and the gate of the driving transistor.

2. An active matrix type display apparatus according to claim 1, wherein the second capacitance has a capacitance value in which a sum of an amount of displacement in the gate control voltage generated when the first switch is turned off and an amount of displacement in the gate control voltage generated when the second switch is turned on is made to be substantially zero.

3. An active matrix type display apparatus according to claim 1, wherein the driving transistor, the first switch, and the second switch are respectively formed of thin-film transistors having semiconductor layers made of polysilicon.

4. An active matrix type display apparatus according to claim 1, wherein the first switch and the second switch are respectively formed of thin-film transistors having the same conductivity, a drain of the second switch is connected to the self-luminescent element, a source of the second switch is connected to the drain of the driving transistor, and the second capacitance is connected between the source of the second switch and the gate of the driving transistor.

5. An active matrix type display apparatus according to claim 1, wherein the second capacitance is formed of a parallel plate capacitance.

6. An active matrix type display apparatus according to claim 1, wherein the second capacitance is formed of a parallel inter-wiring capacitance.

7. An active matrix type display apparatus according to claim 1, wherein the supplied electric current is set on the basis of an electric current signal.

8. An active matrix type display apparatus according to claim 1, wherein the self-luminescent element has a pair of electrodes facing each other, and an organic emitting layer positioned between the electrodes.

* * * * *